United States Patent [19]

Hiramatsu et al.

[11] Patent Number: 4,821,658

[45] Date of Patent: Apr. 18, 1989

[54] APPARATUS FOR SETTING A WORKPIECE CORRECTLY ON A SKIRT-ZIPPER SEWING MACHINE

[75] Inventors: Tooru Hiramatsu; Shigeru Tobita, both of Chofu, Japan

[73] Assignee: Tokyo Juki Industrial Co., Ltd., Chofu, Japan

[21] Appl. No.: 117,236

[22] Filed: Nov. 5, 1987

[30] Foreign Application Priority Data

Nov. 8, 1986 [JP] Japan ..... 61-266259

[51] Int. Cl.[4] ..... D05B 3/12

[52] U.S. Cl. ..... 112/114; 112/265.2

[58] Field of Search ..... 112/114, 121.15, 121.26, 112/121.27, 104, 70, 74, 76

[56] References Cited

U.S. PATENT DOCUMENTS

| | | | |
|---|---|---|---|
| 2,410,399 | 10/1946 | Wood | 112/114 |
| 3,919,942 | 11/1975 | Galya et al. | 112/166 |
| 4,109,591 | 8/1978 | Rakacs | 112/76 |
| 4,227,471 | 10/1980 | Collbrunn et al. | 112/121.15 X |
| 4,497,270 | 2/1985 | Boser | 112/265.2 |
| 4,648,335 | 3/1987 | Hiramatsu et al. | 112/114 |

FOREIGN PATENT DOCUMENTS

| | | |
|---|---|---|
| 45-20010 | 7/1970 | Japan . |
| 5617068 | 7/1979 | Japan . |
| 55-46341 | 11/1980 | Japan . |
| 61-249496 | 6/1986 | Japan . |
| 61-199893 | 9/1986 | Japan . |
| 61-226091 | 10/1986 | Japan . |
| 62-79092 | 4/1987 | Japan . |
| WO86/02672 | 10/1984 | PCT Int'l Appl. . |

*Primary Examiner*—H. Hampton Hunter

*Attorney, Agent, or Firm*—Morgan & Finnegan

[57] ABSTRACT

The disclosed method and apparatus for setting a workpiece correctly on a skirt-zipper sewing machine provides a pair of pressing plates which are positioned at the center of a zipper when the plates are lowered and which press the material of the workpiece and the zipper to be sewed to it.

Each pressing plate works as a guide to set the to-be-sewn section of the workpiece at the center line of the zipper. The plates are then rasied and again lowered to press the workpiece so that shrink marks that occur in bias curved sections of the workpiece are stretched. In this manner, a zipper is sewed to the workpiece without shrink marks.

7 Claims, 11 Drawing Sheets

APPARATUS FOR SETTING A WORKPIECE CORRECTLY ON A SKIRT-ZIPPER SEWING MACHINE

BACKGROUND OF THE INVENTION

This invention relates to an apparatus for setting a workpiece correctly on a sewing machine designed to sew a zipper to a skirt.

Referring to FIG. 11A, a zipper S is generally sewed to a skirt C with the zipper positioned between the waist line and the hip line. As this portion of the skirt must be curved to conform to the body, the segment of material to which the zipper must be sewn is curved along a bias as shown in FIG. 11B.

To sew a zipper to a section with such a bias curve, a specially designed sewing machine M, shown in FIG. 13, and a cassette 1, shown in FIG. 12, were previously used. Accordingly, referring to FIG. 12, cassette 1 would be placed on a set table 2 such that lower frame 1*a* fit on a zipper guide 2*a*. Zipper F would then be placed on the zipper guide 2*a* so that the zipper became aligned with groove $2a_1$ on the zipper guide.

Skirt material C, to which the zipper was to be sewn, would then be placed on the lower frame 1*a*. Sides $Ca_1$ and $Cb_1$ of the skirt material were then aligned with the center portion of zipper F so that they met on the center line of the zipper. An upper frame 1*b* was then closed, engaging a spring 1*c* with a stopper notch $1d_1$ provided at fixing-bracket 1*d* so that the upper frame 1*b* clamped the zipper.

Referring now to FIG. 13, cassette 1 would then be separated from set table 2 and placed between a pressing plate Ml and a feed plate M2. An air cylinder M3, activated by a foot switch (not shown) would pull plunger M4, causing lever M5 to turn shaft M6 counter-clockwise so that lever M7, whose end is fixed to the shaft M6, turns counter-clockwise and depresses cassette 1. The foot switch (not shown) would then activate the sewing machine. A control apparatus (not shown) would control the vertical action of the needle and the X-Y motion of feed plate 2 in accordance with a predetermined stitch pattern. In this manner, a stitch line S would be performed, sewing the zipper to the skirt material, FIG. 11A.

Assuming that the zipper F and the to-be-sewn sections of material are correctly aligned in cassette 1 before sewing begins, an operator can sew the zipper to the material correctly and speedily.

More recently, an automatic setting apparatus 3 for aligning and setting a zipper on material has been introduced as shown in FIG. 14. The apparatus in FIG. 14 was described in U.S. Pat. No. 4,648,335, "Apparatus for Setting a Workpiece Correctly on a Sewing Machine" by some of the same inventors as in the present invention. According to this patent, skirt edges Ca and Cb, which are turned down, are inserted by setting plates 31*a* and 31*b*, respectively, which are positioned in V-formation. After insertion, the setting plates 31*a* and 31*b* close so that sides $Ca_1$ and $Cb_1$ of the to-be-sewn edges Ca and Cb meet along the inside straight lining of setting plates 31*a* and 31*b*. After edges Ca and Cb meet, upper frame 1*b* closes and is fixed by spring 1*c*, depressing the workpiece. Setting plates 31*a* and 31*b* then expand outwardly and are separated from the material C. In this manner, the zipper is correctly set on skirt material C.

V-formed setting plates 31*a* and 31*b* are closed by V-formed levers 36*a* and 36*b*. Levers 36*a* and 36*b* are activated by air cylinders 32*a* and 32*b* which are connected to the levers by drawing plungers 33*a* and 33*b*, links 34*a* and 34*b*, and pins 35*a* and 35*b*. To separate the setting plates 31*a* and 31*b* from the skirt material C, plungers 38*a* and 38*b* of air cylinders 37*a* and 37*b* (not shown) are withdrawn. This causes arm 40*a* to rotate counter-clockwise, keeping shaft 39*a* at the center of rotation, and arm 40*b* to rotate clockwise, keeping shaft 39*b* as its center. In this manner, setting plates 31*a* and 31*b* expand outwardly and are separated from the skirt.

Accordingly, with the conventional setting apparatus, when the bias curved edges $Ca_1$ and $Cb_1$ of to-be-sewn material sections Ca and Cb met at the straight end of setting plates 31*a* and 31*b*, the skirt material naturally shrank and became wrinkled as shown in FIG. 11C. Correct setting was thus impossble using this apparatus.

SUMMARY OF THE INVENTION

It is therefore an object of the invention to improve the above-described situation and to propose a more advanced apparatus for setting a workpiece correctly on a skirt-zipper sewing machine.

The present invention solves the aforementioned problems by providing pressing plates which work first as guides to position the sides of to-be-sewn material sections at the center line of a zipper by lowering the pressing plate. The pressing plates then work second as a press to stretch shrinks marks developed in the to-be-sewn sections by alternately lifting and lowering each of the plates.

The cross-section of each of the pressing plates is L-shaped to most effectively stretch shrinks marks in the material.

BRIEF DESCRIPTION OF THE DRAWINGS

The invention will be described in greater detail below by way of reference to the following drawings, in which:

FIG. 4 is a cross-sectional view shown along line Z—Z of FIG. 3;

FIG. 8 is a cross-sectional view shown along line Y—Y of FIG. 6;

DESCRIPTION OF THE PREFERRED EMBODIMENT

Referring more particularly now to the accompanying drawings, FIG. 1 through FIG. 10 illustrate a preferred embodiment of the present invention.

Throughout the figures, the same numerals will be used when referring to parts that function similarly.

Figure 1:
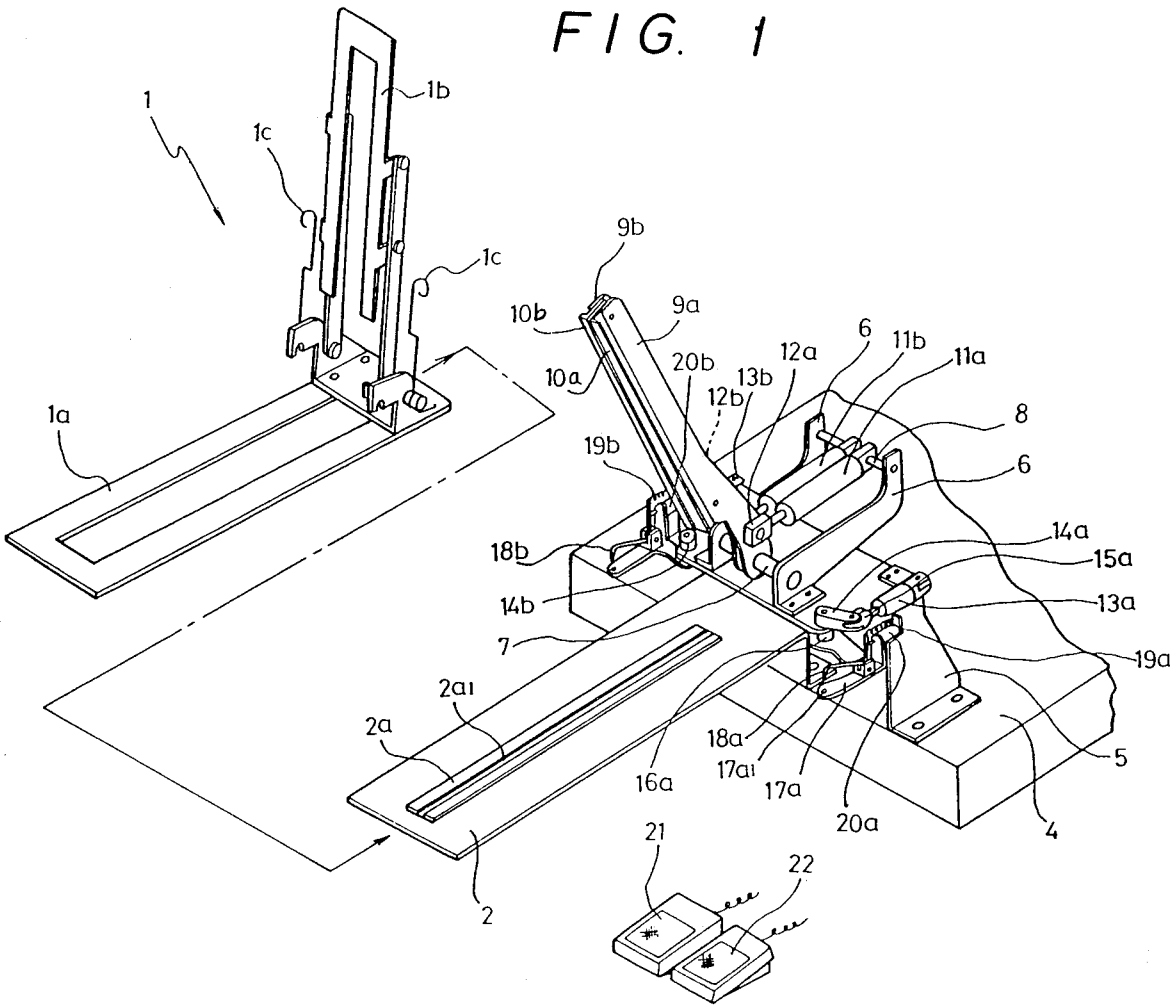
FIG. 1 is a perspective view of an apparatus for setting a workpiece correctly on a skirt-zipper sewing machine according to the present invention.

FIG. 1 shows a table 4, channel-like bracket 5 fixed to table 4, and brackets 6, fixed to bracket 5, which support shafts 7 and 8. The ends of pressing arms 9*a* and 9*b* pivot and can rotate on shaft 7.

Pressing plates 10*a* and 10*b* are fixed to pressing arms 9*a* and 9*b*, respectively. In cross-section, pressing plates 10*a* and 10*b* are L-shaped such that the bottom of the "L" of the pressing plates extend outwardly. Air cylinders 11*a* and 11*b* cause pressing plates 10*a* and 10*b* to rotate, respectively, around shaft 7. The end of air cylinders 11*a* and 11*b* pivot and can rotate on shaft 8. Cylinder knuckles 12*a* and 12*b* connect air cylinder plungers 11*a* and 11*b* to pressing arms 9*a* and 9*b*. Air cylinders 13*a* and 13*b* are fixed at the end of bracket 5. Links 14*a* and 14*b* are connected at one end to the plungers of cylinders 13*a* and 13*b* via cylinder knuckles 15*a* and 15*b*, respectively. The other ends of links 14*a* and 14*b* are fixed to shafts 16*a* and 16*b*, respectively. L-shaped setting plates 17*a* and 17*b* are fixed to shafts 16*a* and 16*b*, respectively. Stop-pins 18*a* and 18*b* each have an end that pivots such that air cylinders 20*a* and 20*b* cause the stop-pins to fall into pinholes $17a_1$ and $17b_1$, respectively, affixing the workpiece. Springs 19*a* and 19*b* normally lift up stop-pins 18*a* and 18*b*.

Accordingly, as previously described, stop-pins 18*a* and 18*b*, springs 19*a* and 19*b*, and air cylinders 20*a* and 20*b* comprise means to hold the workpiece.

Foot switches 21 and 22 actuate the apparatus.

Figure 2:
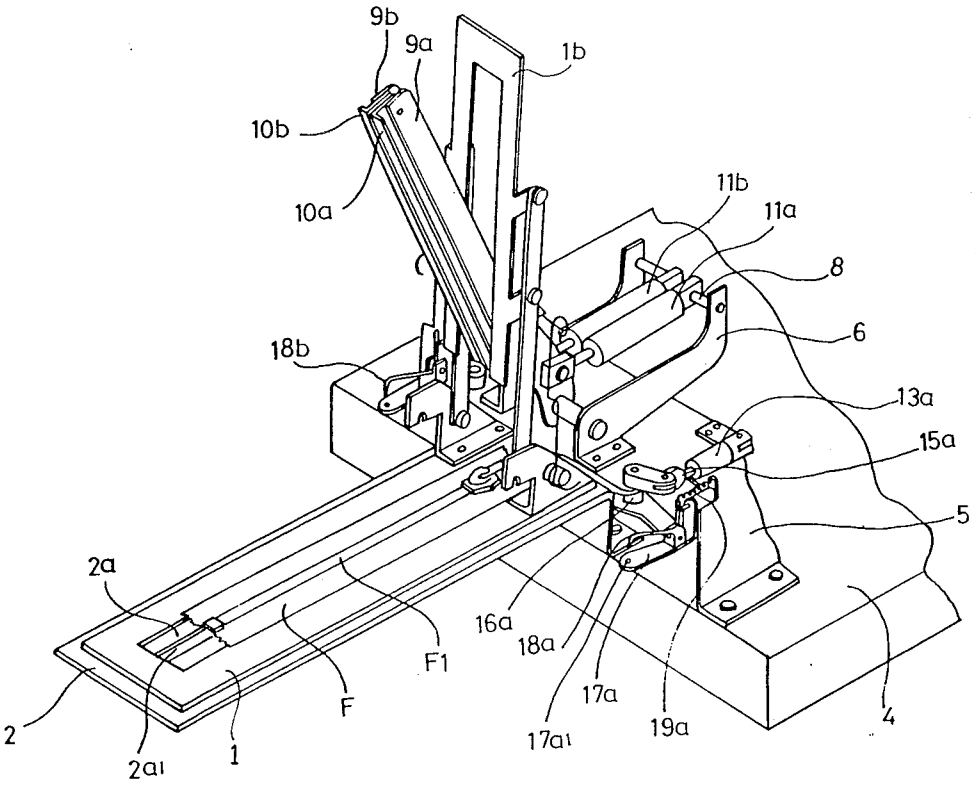
FIG. 2 through FIG. 10 illustrate the operation of one embodiment of the invention.

In accord with the aforementioned arrangement, to operate the apparatus, zipper F is placed on zipper guide 2*a*, FIG. 2.

Figure 4:
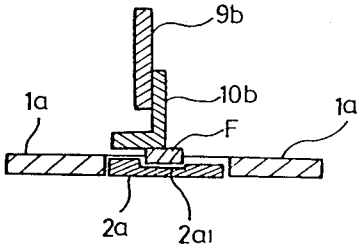
Figure 3:
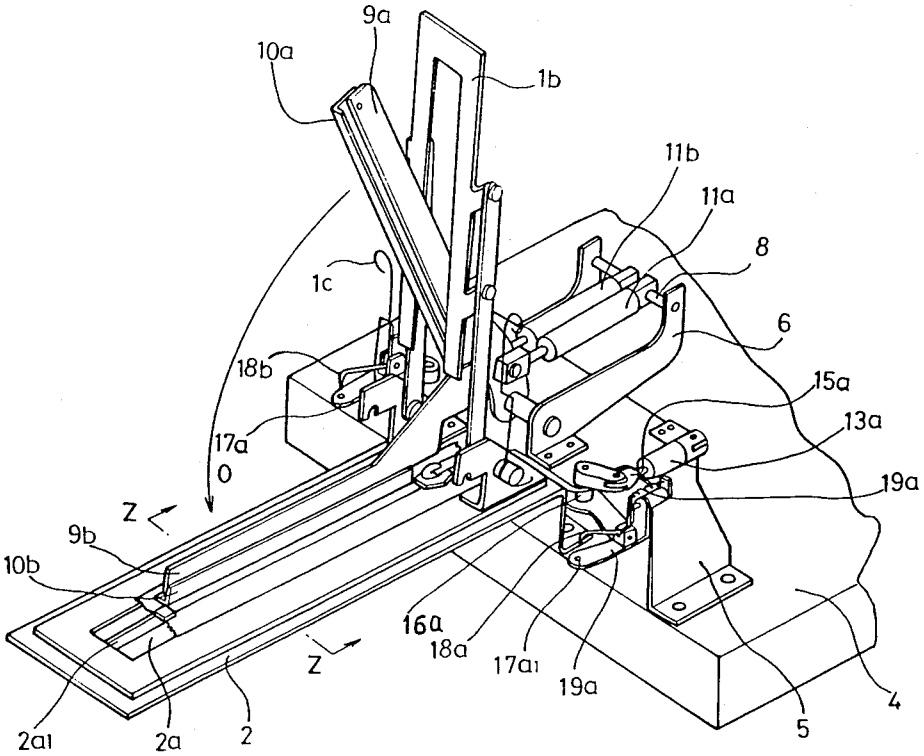
Figure 5:
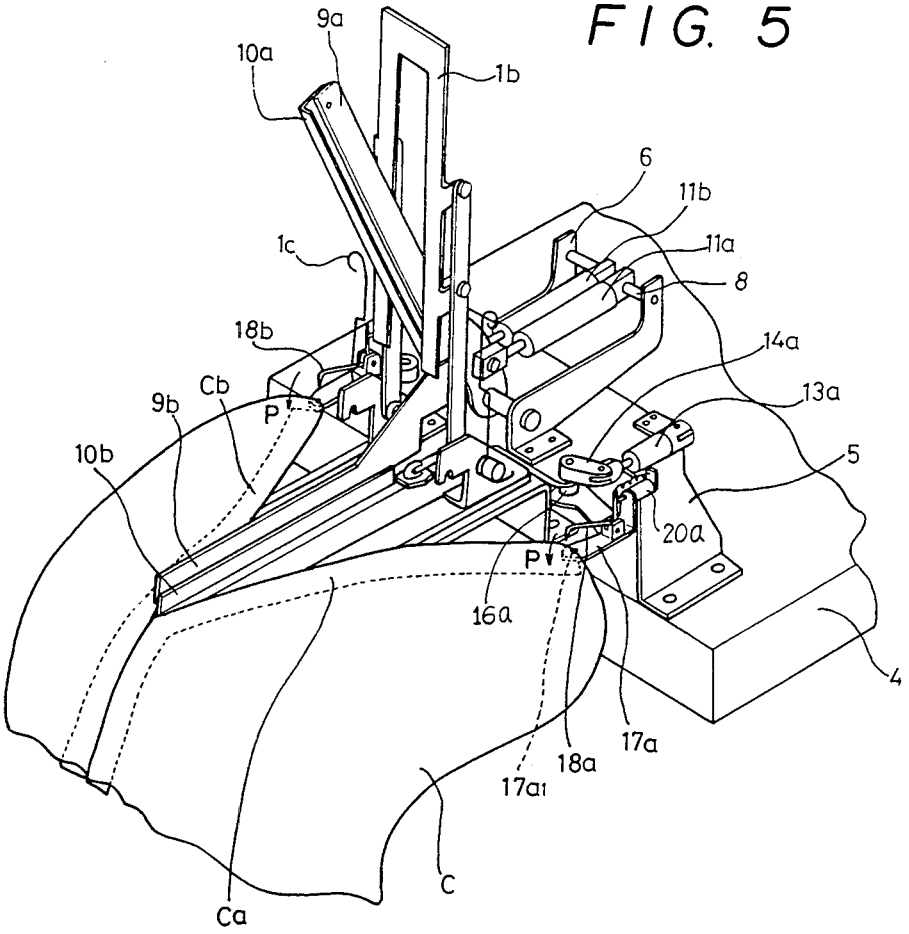
Figure 6:
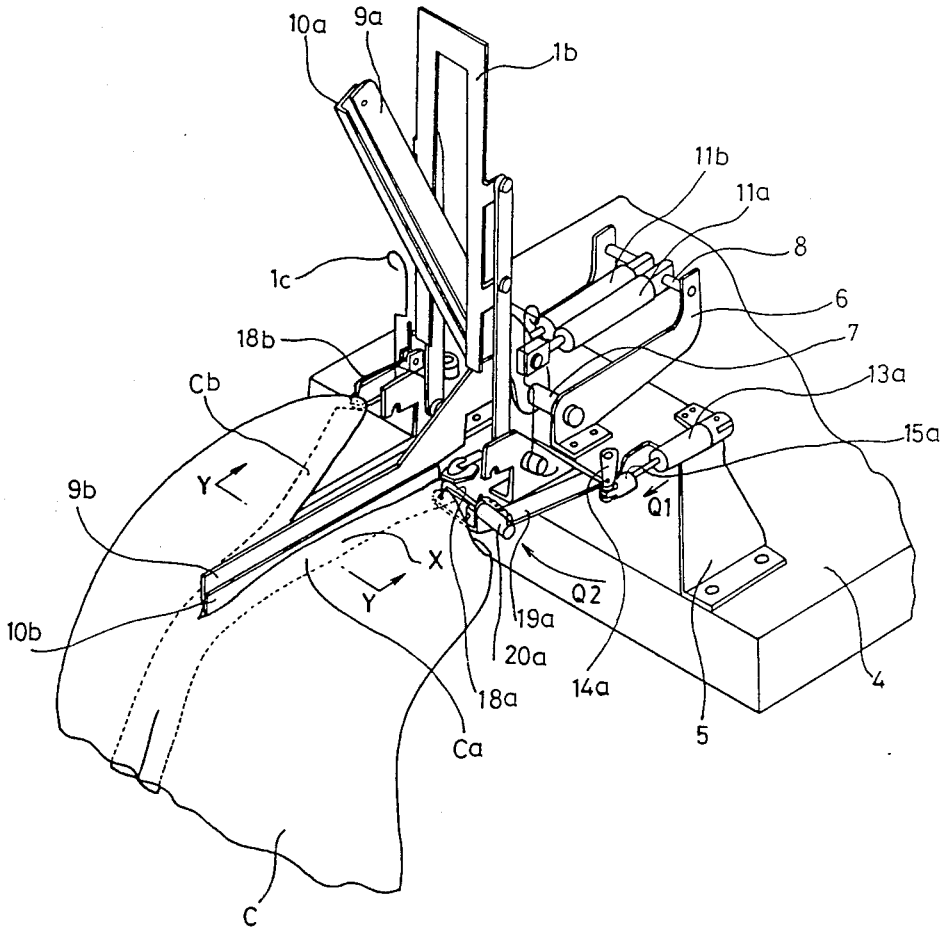

When the appropriate foot switch is pressed, air cylinder 11*b* expands and pressing arm 9*b* rotates counterclockwise as indicated by arrow O in FIG. 3. Thus, zipper F, FIG. 4, is depressed by pressing plate 10. FIG. 4 shows this pressing action along line Z—Z of FIG. 3. Skirt material C is then inserted through pressing plate 10*b* until the bifurcated base of skirt C is stopped by the tip of pressing plate 10*b*, FIG. 5. The upper ends o the unsewn portion of Ca and Cb are then placed on set table 20. When foot switch 21 is pressed, air cylinder 20*a* expands and the tip of stop pin 18*a* rotates according to arrow P, affixing the upper portion of to-be-sewn section Ca as shown in FIG. 5.

As foot switch 21 is further depressed, air cylinder 13*a* expands and link 14*a* rotates clockwise. This causes shaft 16*a* to simultaneously rotate clockwise. As a result, setting plate 17*a* turns in the direction indicated by arrow Q2 in FIG. 6. In this manner, to-be-sewn material section Ca meets the straight inside surface of pressing plate 10*b*.

Figure 7:
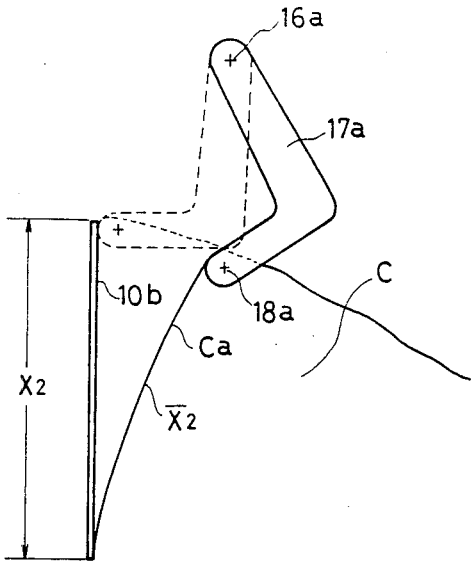

Referring to FIG. 7, the edge of material section Ca is stretch-fitted against pressing plate 10*b* as setting plate 17*a* is rotated clockwise. Thus, the length $X_2$, of the pressing plate 10*b* shall be almost equal to the peripheral length $X_2$ of the to-be-sewn material section Ca.

Figure 8:
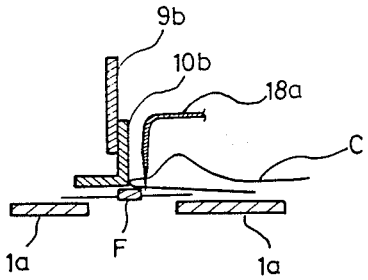

Since the end of material Portion Ca is bias curved and the inside surface of pressing plate 10*b* is straight, shrink marks will be formed in skirt material C as shown in FIG. 8. FIG. 8 is a cross-sectional view along line Y—Y of FIG. 6.

Figure 9:
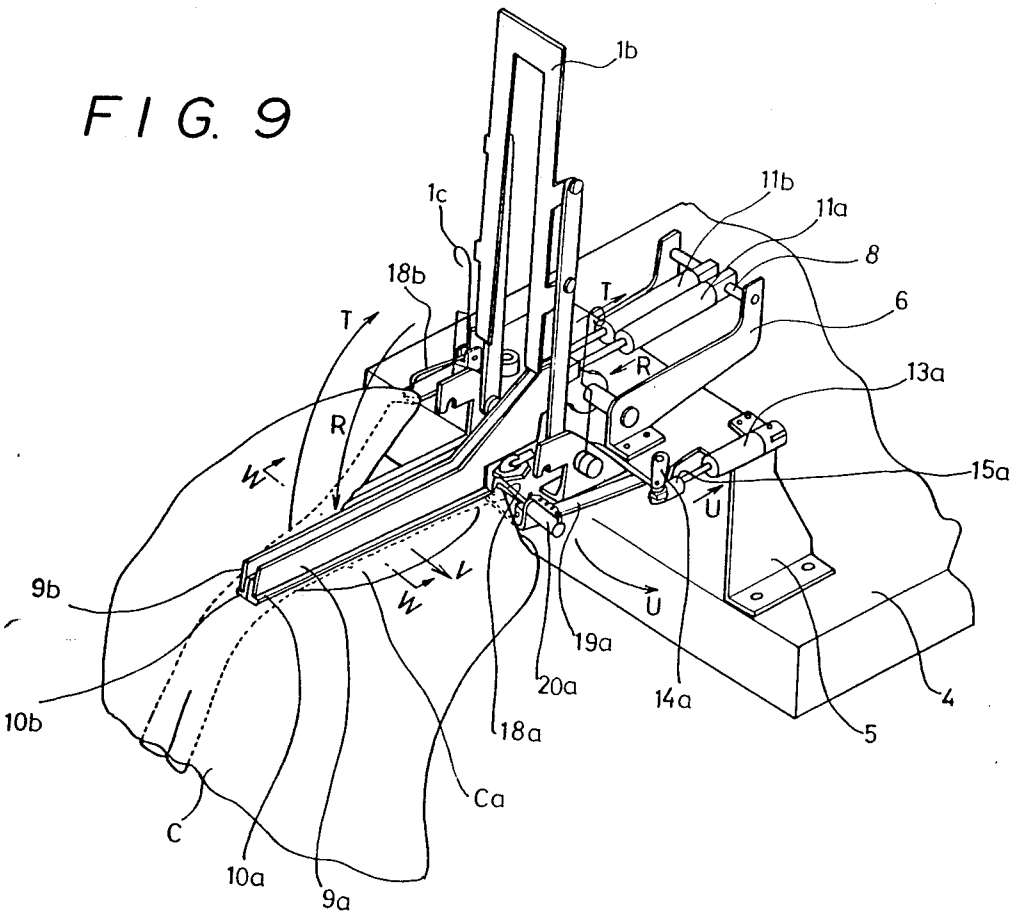
Figure 10:
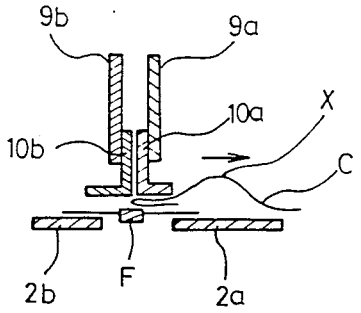
Figure 11A:
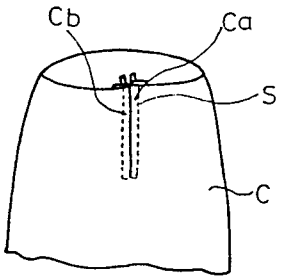
FIG. 11A (PRIOR ART)
FIG. 11A is a perspective view of a skirt with a zipper sewed to it.
Figure 11B:
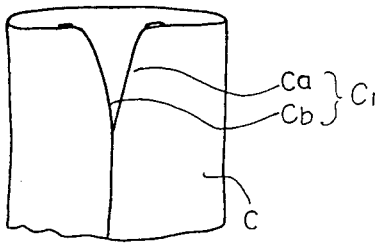
FIG. 11B (PRIOR ART)
FIG. 11B is a perspective view of a skirt before a zipper is sewn to the unjoined sections.
Figure 11C:
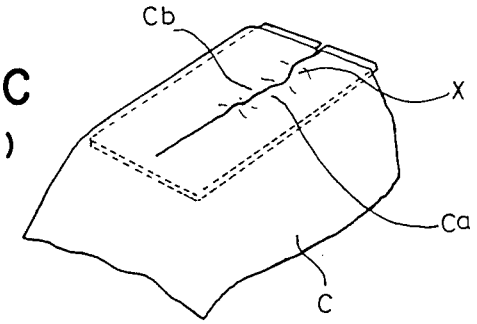
FIG. 11C (PRIOR ART)
FIG. 11C is a perspective view of a portion of a skirt with edges sewn to a zipper according to a prior art method.
Figure 12:
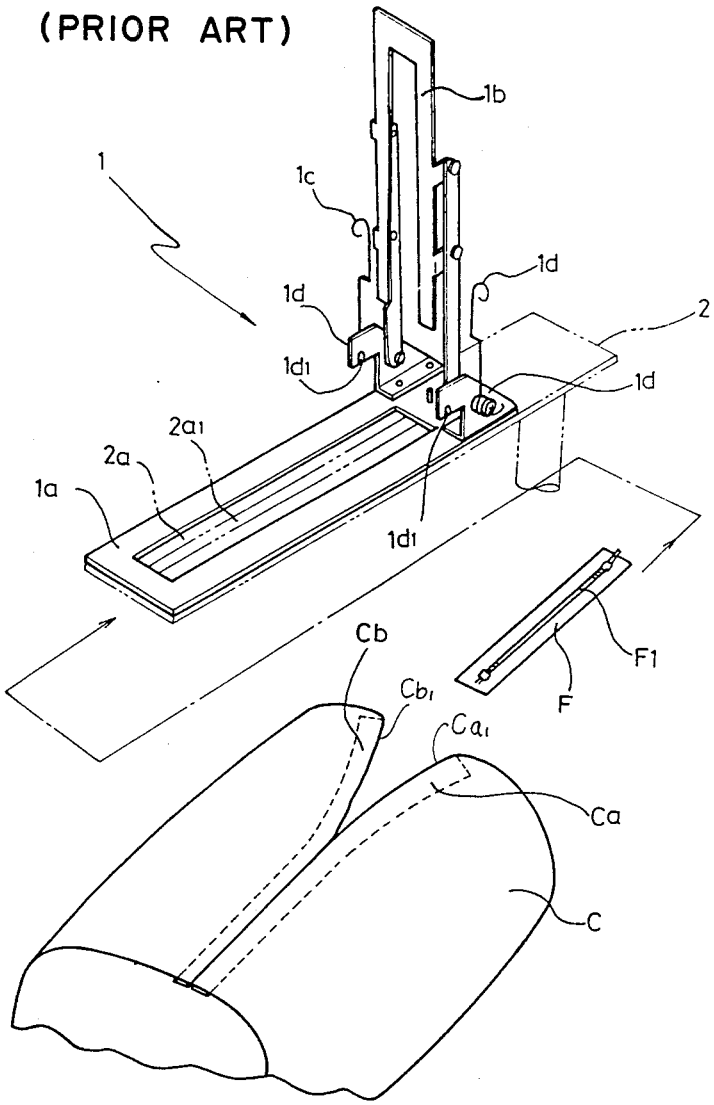
FIG. 12 (PRIOR ART)
FIG. 12 is a perspective view of a cassette according to the prior art.
Figure 13:
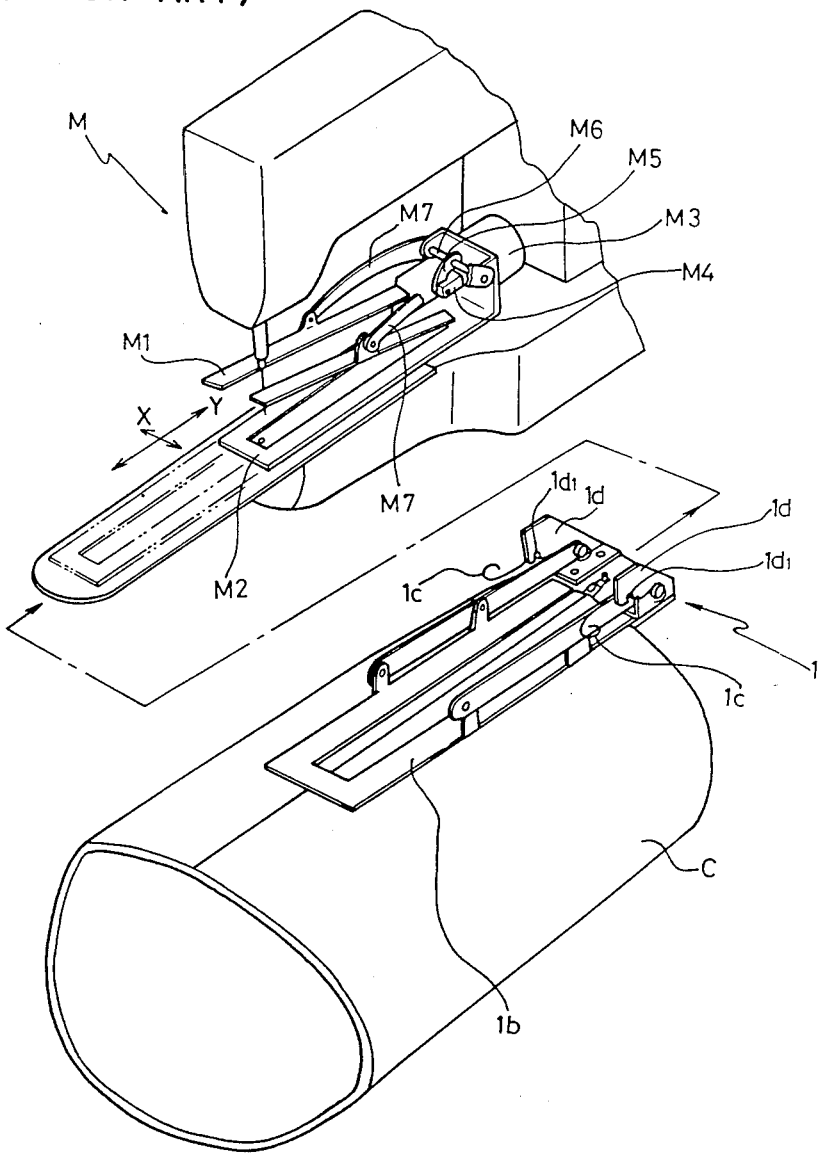
FIG. 13 (PRIOR ART)
FIG. 13 is a perspective view of a prior art sewing machine designed exclusively to sew a zipper.
Figure 14:
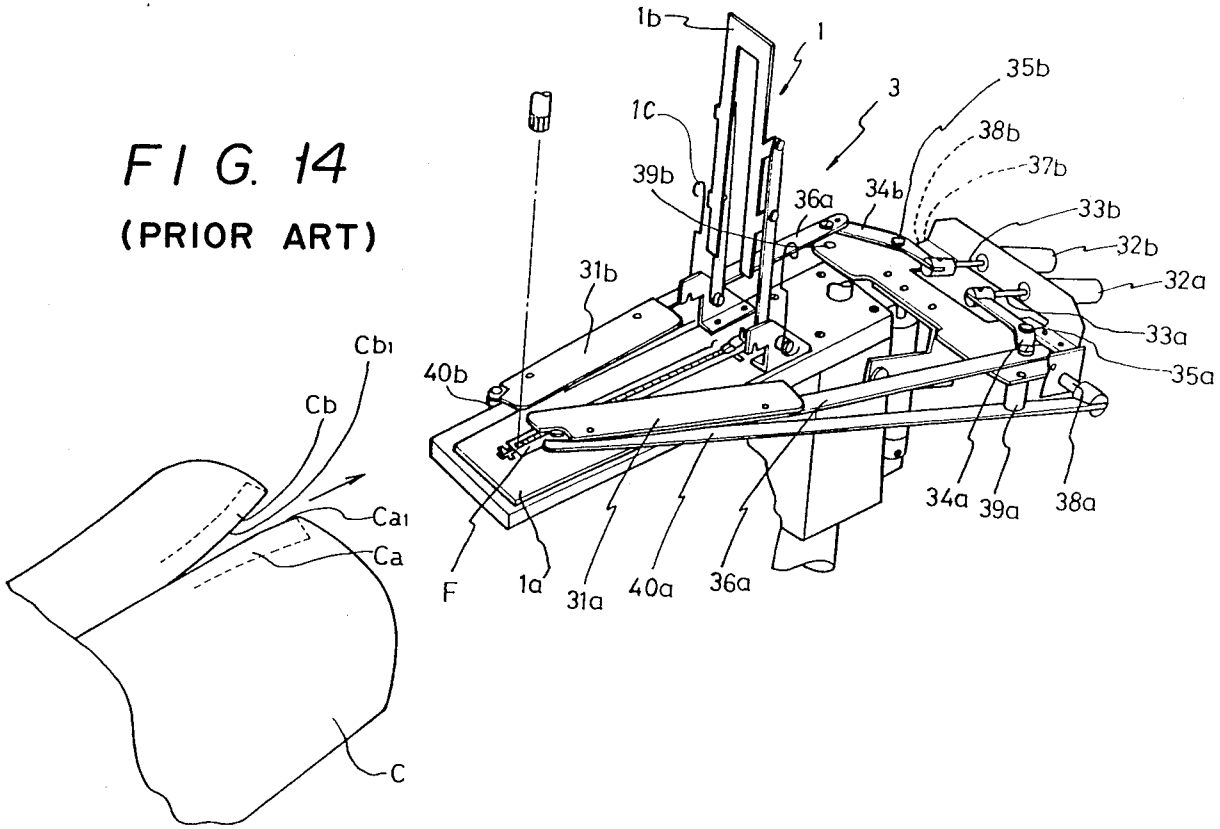
FIG. 14 (PRIOR ART)
FIG. 14 is a perspective view of a prior art apparatus for setting a workpiece correctly.

When foot switch 21 is pressed, air cylinder 11*a* expands and pressing arm 9*a* rotates in the direction of curved arrow R in FIG. 9 so that the pressing plate 10*a* presses against to-be-sewn material section Ca. When pressing plate 10*a* presses the skirt material C, shrink marks that develop in the to-be-sewn portion are moved in the direction of arrow V in FIG. 9 and FIG. 10 so that the to be-sewn portion Ca forms a flat surface without shrink marks. As foot-switch 21 is pressed, air cylinder 11*b* withdraws so that pressing arm 9*b* and pressing plate 10*b* rotate according to curved arrow T in FIG. 9 to resume their original position. Thus, the to-be-sewn Ca is correctly placed on the zipper without shrink marks.

The same sequence is applied to the to-be-sewn material section Cb. This includes holding the upper portion of material Cb by the stop-pins 18*b*, meeting the end of material Cb with the straight end of pressing plate 10*a*, and pressing segment Cb with the pressing plate 10*b* so that shrink marks that develop in the material move outwardly, forming a flat surface without shrink marks in segment Cb.

After setting both segments Ca and Cb correctly, the upper frame 1*b* of cassette 1 is lowered, pressing skirt material C through the action of springs 1*c*. When the upper frame 1*b* depresses skirt material C, shrink marks moved outwards in the direction of arrow V in FIG. 9 are driven further outwards, thus keeping the to-be-sewn sections Ca and Cb flat and without such shrink marks.

In this manner, according to the invention, both sides Ca and Cb of the to-be-sewn sections of skirt neatly meet. In this state, the zipper is sewed to the material without the shrink marks often experienced. Shrink marks in this section are thus eliminated, improving quality and resulting additionally in higher productivity.

As many apparently widely different embodiments of this invention may be made without departing from its spirit and scope, it should be understood that the invention is not limited to the specific embodiment disclosed and described herein, except as defined in the appended claims.

What is claimed is:

1. An apparatus for setting a workpiece correctly on a skirt-zipper sewing machine comprising:

a cassette having an upper frame and a lower frame for clamping the workpiece to a zipper;

pressing plates positioned within the cassette frames for aligning the workpiece with the zipper and for pressing and stretching the workpiece; and means for controllably moving the upper frame, the lower frame, and the pressing plates so that the plates and the frame clamp the zipper to the workpiece to prevent the formation of shrink marks in the workpiece prior to and during the sewing of the zipper to the workpiece.

2. An apparatus according to claim 1 wherein the cassette is detachably mounted on a set-table.

3. An apparatus according to claim 1 wherein the pressing plates are L-shaped.

4. An apparatus according to claim 1 further comprising:

driving means for alternately raising and lowering the pressing plates;

holding means for holding upper ends of sections of the workpiece; and moving means for aligning the sections of the workpiece held by the holding means with the pressing plate for alignment with the zipper to be sewn to the workpiece.

5. An apparatus according to claim 4 wherein the driving means comprises an air cylinder.

6. An apparatus according to claim 4 wherein the holding means comprises a pin that presses against the workpiece, said pin being pressed by a piston of an air cylinder.

7. An apparatus for setting a workpiece correctly on a skirt-zipper sewing machine comprising:

a cassette having a lower frame and an upper frame, the upper frame which may be closed and subsequently reopened against the lower frame;

a set-table upon which the cassette is detachably mounted;

a pair of pressing plates having an L-shaped cross-section designed to be positioned inside of the lower frame when said lower and upper frames are closed;

driving means for alternately raising and lowering the pair of pressing plates;

a pair of holding means for holding upper ends of two sections of a material workpiece to which a zipper is to be sewn, said sections having bias curves;

a pair of moving means upon which the upper ends of the two sections of the workpiece are held by the holding means for moving said upper ends of the workpiece sections to the end of said pressing plates when said plates are in a lowered position; and control means for controlling the section of the pair of pressing plates, the pair of moving means, and the upper frame so that the area adjacent to the sections of material to which the zipper is to be sewn are pressed and stretched by the pressing plates and are further clamped by the upper frame and the lower frame of the cassette.

* * * * *

UNITED STATES PATENT AND TRADEMARK OFFICE

CERTIFICATE OF CORRECTION

PATENT NO. : 4,821,658

DATED : April 18, 1989

INVENTOR(S) : Tooru Hiramatsu; Shigeru Tobita

It is certified that error appears in the above-identified patent and that said Letters Patent is hereby corrected as shown below:

Col. 6, line 14, "section" should read -- action --.

Signed and Sealed this

Fifth Day of December, 1989

*Attest:*

JEFFREY M. SAMUELS

*Attesting Officer*

*Acting Commissioner of Patents and Trademarks*